US005686824A

United States Patent [19]

Rapp

[11] Patent Number: 5,686,824

[45] Date of Patent: Nov. 11, 1997

[54] VOLTAGE REGULATOR WITH VIRTUALLY ZERO POWER DISSIPATION

[75] Inventor: A. Karl Rapp, Los Gatos, Calif.

[73] Assignee: National Semiconductor Corporation, Santa Clara, Calif.

[21] Appl. No.: 721,895

[22] Filed: Sep. 27, 1996

[51] Int. Cl.[6] ..... G05F 3/16

[52] U.S. Cl. ..... 323/313; 323/315

[58] Field of Search ..... 323/312, 313, 323/314, 315, 316, 317; 327/538, 539, 544, 545

[56] References Cited

U.S. PATENT DOCUMENTS

| | | | |
|---|---|---|---|
| 4,808,909 | 2/1989 | Eddlemon | 323/313 |
| 5,059,890 | 10/1991 | Yoshikawa et al. | 323/315 |
| 5,384,739 | 1/1995 | Keeth | 365/189.09 |
| 5,453,679 | 9/1995 | Rapp | 323/313 |
| 5,512,814 | 4/1996 | Allman | 323/267 |

OTHER PUBLICATIONS

Eric Vittoz and Jean Fellrath, "CMOS Analog Integrated Circuits Based on Weak Inversion Operation", IEEE Journal of Solid–State Circuits, vol. SC–12, No. 3, Jun. 1977, pp. 224–231.

*Primary Examiner*—Matthew V. Nguyen
*Attorney, Agent, or Firm*—Limbach & Limbach L.L.P.

[57] ABSTRACT

A voltage regulator for coupling to an unregulated power source and regulating a voltage and conveying a current received from such source includes a bias voltage generator and a voltage translator which together dissipate virtually zero power while providing such voltage regulation and current conveyance. The bias voltage generator produces a stable reference current for purposes of generating stable bias voltages for the voltage translator. The voltage translator generates a regulated output voltage by translating a reference voltage potential (e.g., circuit ground) upwards by an amount equal to multiple depletion mode transistor threshold voltages.

16 Claims, 11 Drawing Sheets

VOLTAGE REGULATOR WITH VIRTUALLY ZERO POWER DISSIPATION

BACKGROUND OF THE INVENTION

1. Field of the Invention

The present invention relates to voltage regulator circuits, and in particular, to voltage regulator circuits which provide a regulated output voltage based upon an unregulated input voltage while being powered by the unregulated voltage source and using a minimal amount of supply current from such source.

2. Description of the Related Art

Voltage regulators, in general, are well known and widely used in the art. Such circuits receive an unregulated, or "raw," voltage from a power source and produce a regulated voltage therefrom. Typically, the voltage regulator circuit relies upon the source of the unregulated voltage for the supply current necessary for it to perform its regulation function.

However, some applications for voltage regulators involve power, or energy, sources from which only a very limited amount of power is available to supply the voltage regulator circuit (e.g., electromagnetic or thermal energy in a surrounding environment). Hence, when generating a regulated voltage based upon power extracted from such sources, the voltage regulator must do so with minimal use of current from such sources. Further, due to the variability of the power available from such sources at any given time, such circuit must also often be able to recognize and indicate when the regulated output voltage is suitable, e.g., high enough, for the circuit which is relying upon it. Additionally, there is often an accompanying need for a reference current which remains stable, along with the regulated voltage output, regardless of variations in the power extracted, for purposes of performing the voltage regulation function. Again, such reference current must be generated while using a minimal amount of current from the power source.

SUMMARY OF THE INVENTION

In accordance with the present invention, power is extracted from an energy source and regulated to produce a stable reference current for purposes of generating a regulated voltage source. Both functions are accomplished with minimal use of power from the original energy source.

In accordance with one embodiment of the present invention, a voltage regulator for coupling to an unregulated power source and regulating a voltage and conveying a current received therefrom includes a reference node, an input node, a bias voltage generator and a voltage translator. The reference node is configured to operate at a reference voltage having a fixed reference voltage potential. The input node is configured to be coupled to an unregulated power source, convey a source current therefrom and receive and convey an input voltage having an input voltage potential relative to the fixed reference voltage potential. The difference between the first input voltage and the reference voltage has an input voltage magnitude which is greater than a predetermined minimum. The bias voltage generator is coupled between the input node and the reference node and is configured to receive the input voltage and the reference voltage and in accordance therewith provide a bias voltage having a bias voltage potential between the first input voltage potential and the fixed reference voltage potential. The voltage translator is coupled between the input node and the reference node and to the bias voltage generator and is configured to receive the input voltage, the reference voltage and the bias voltage and in accordance therewith convey the source current and provide a regulated voltage having a regulated voltage potential between the input voltage potential and the fixed reference voltage potential. The regulated voltage is translated from the reference voltage and the regulated voltage potential is substantially fixed relative to the fixed reference voltage potential and remains substantially fixed relative thereto regardless of variations in the input voltage magnitude.

In accordance with another embodiment of the present invention, the voltage regulator further includes a second input node and a buffer circuit. The second input node is configured to be coupled between the unregulated power source and the first input node, convey therefrom the source current and receive and convey therefrom a second input voltage having a second input voltage potential relative to the fixed reference voltage potential. The first input voltage potential is between the second input voltage potential and the fixed reference voltage potential, and the difference between the second input voltage and the reference voltage has a second input voltage magnitude which is greater than a second predetermined minimum. The buffer circuit is coupled between the second input node and the first input node and is configured to receive the second input voltage and the regulated voltage and in accordance therewith provide the first input voltage and convey the source current. The regulated voltage potential remains substantially fixed relative to the fixed reference voltage potential regardless of variations in the second input voltage magnitude.

These and other features and advantages of the present invention will be understood upon consideration of the following detailed description of the invention and the accompanying drawings.

DETAILED DESCRIPTION OF THE INVENTION

Throughout the figures, unless identified otherwise, the transistors are enhancement mode P-type or N-type metal oxide semiconductor field effect transistors (P-MOSFETs and N-MOSFETs, respectively). Those transistors which are instead depletion mode devices are identified as such with the additional designator "D." The P-MOSFETs and N-MOSFETs are identified with "P" and "N" designators, respectively. Also throughout the figures, designators in a "W/L" format are included to indicate the sizes of the corresponding MOSFETs, i.e., with the "W" designator identifying the width and the "L" designator identifying the length of the MOSFET channel.

Figure 1:
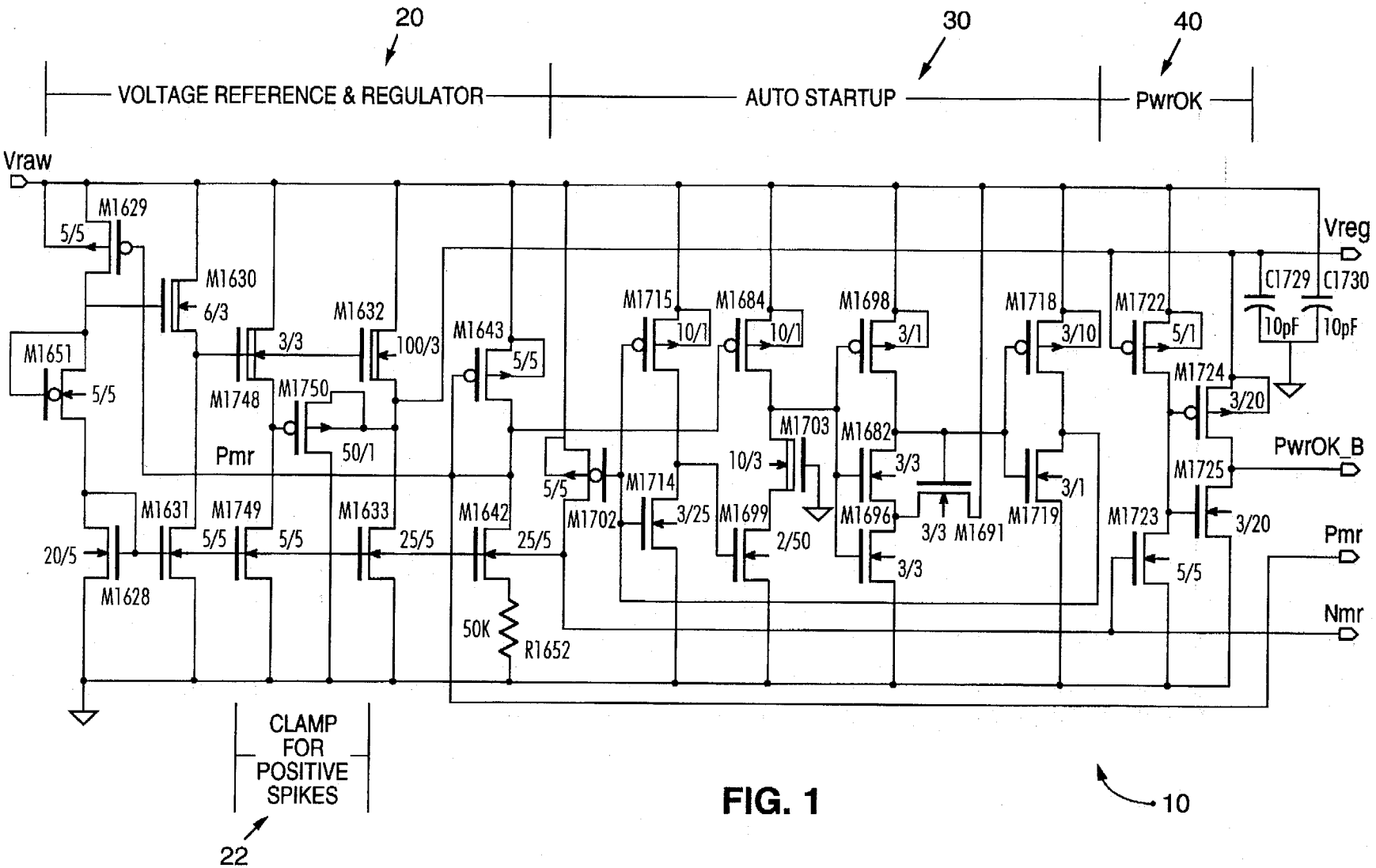
FIG. 1 is a schematic diagram of a voltage reference and regulator, power-ok indicator and automatic startup circuit containing a voltage regulator in accordance with one embodiment of the present invention.

Referring to FIG. 1, a voltage reference and regulator, power-ok indicator and automatic startup circuit containing a voltage regulator in accordance with one embodiment of the present invention includes a voltage reference and regulator section 20, an automatic startup section 30 and a power-ok indicator section 40. The voltage reference and regulator section 20 also includes a voltage clamp circuit 22. As discussed in more detail below, an unregulated voltage VRAW is received from a relatively high impedance, low power positive voltage source. The voltage reference and regulator section 20 uses current mirrors to establish reference currents so as to generate a number of reference voltages PMR, NMR for P- and N-channel enhancement mode MOSFETs. The N-channel reference voltage NMR is used to establish some weak source currents for a series of cascaded N-channel depletion-mode transistor source follower circuits. The output voltages of the individual source follower circuits become progressively more positive, i.e., with respect to circuit ground, due to the negative threshold voltages of the depletion mode transistors used in the source follower circuits. The output of the last source follower stage provides a regulated output voltage VREG and conveys an output current from the unregulated voltage source while limiting the maximum voltage of the regulated output voltage VREG.

As discussed in more detail below, the automatic startup section 30 ensures that the current mirror reference voltages remain established during the time that a sufficiently high unregulated supply voltage VRAW remains applied to the circuit 10.

As also discussed in more detail below, the power-ok indicator section 40 uses a P-MOSFET to detect the condition when the unregulated supply voltage VRAW exceeds the regulated output voltage VREG by a predetermined mount (e.g., a P-MOSFET threshold voltage). Upon fulfillment of this condition, i.e., when the regulated output voltage VREG has reached its predetermined value, the power-ok indicator section 40 signals that the output voltage VREG can be used by indicating that power is "ok."

Figure 2:
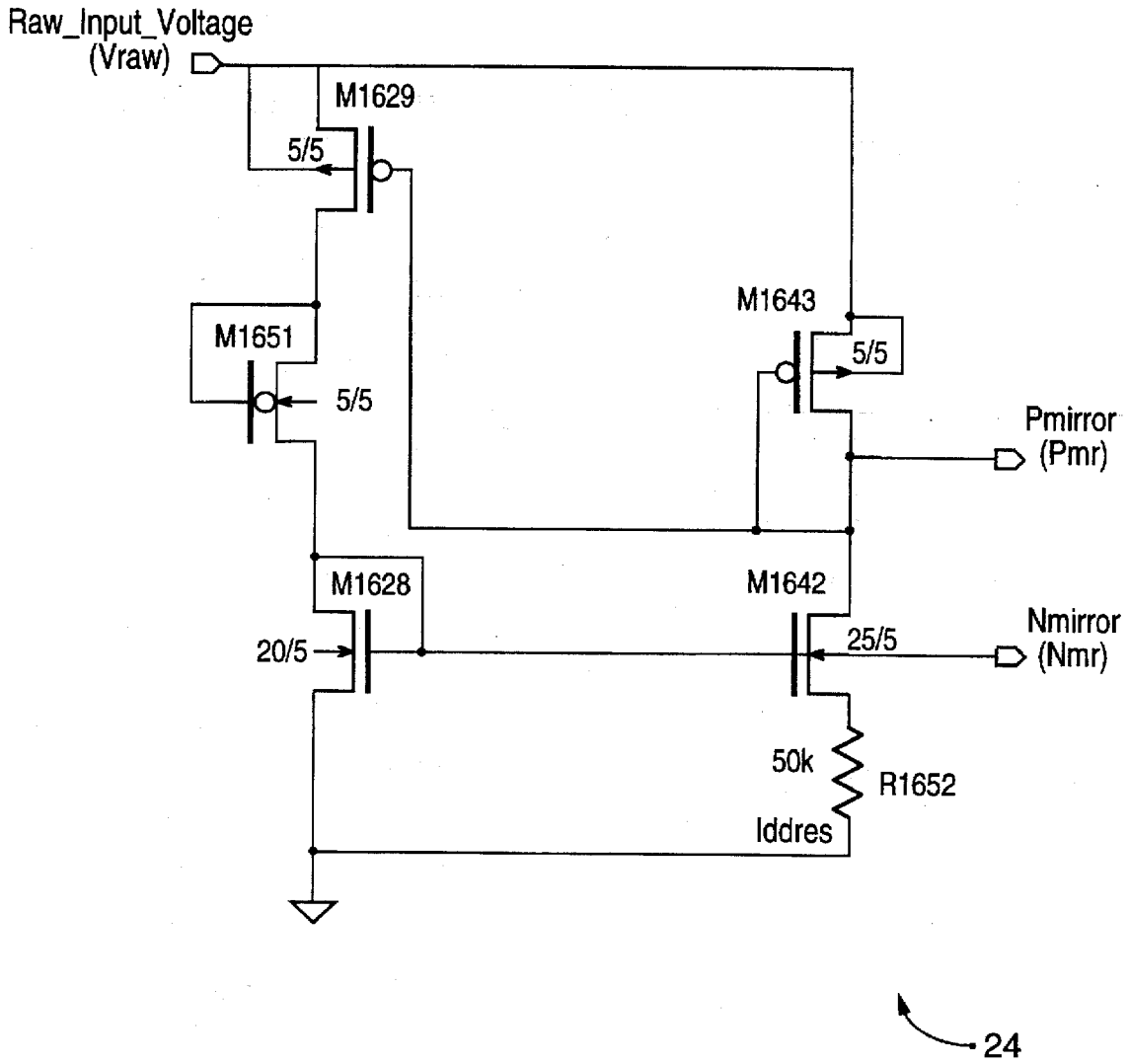
FIG. 2 (PRIOR ART)
FIG. 2 is a schematic diagram of the conventional voltage reference generator portion of the circuit of FIG. 1.

Referring to FIG. 2, the voltage reference portion 24 of the voltage reference and regulator section 20 includes a pair of P-MOSFET and N-MOSFET current mirror stages coupled together in a stacked configuration, along with a resistor. (Transistor M1651 is a native transistor which plays no role in the current mirror action of either current mirror circuit.) In accordance with well known current mirror circuit characteristics, the voltage reference PMR, NMR levels are established in accordance with the currents conducted in the two circuit branches, the magnitudes of which are, in turn, dependent upon the sizes of the transistors and the value of the resistor.

Figure 3:
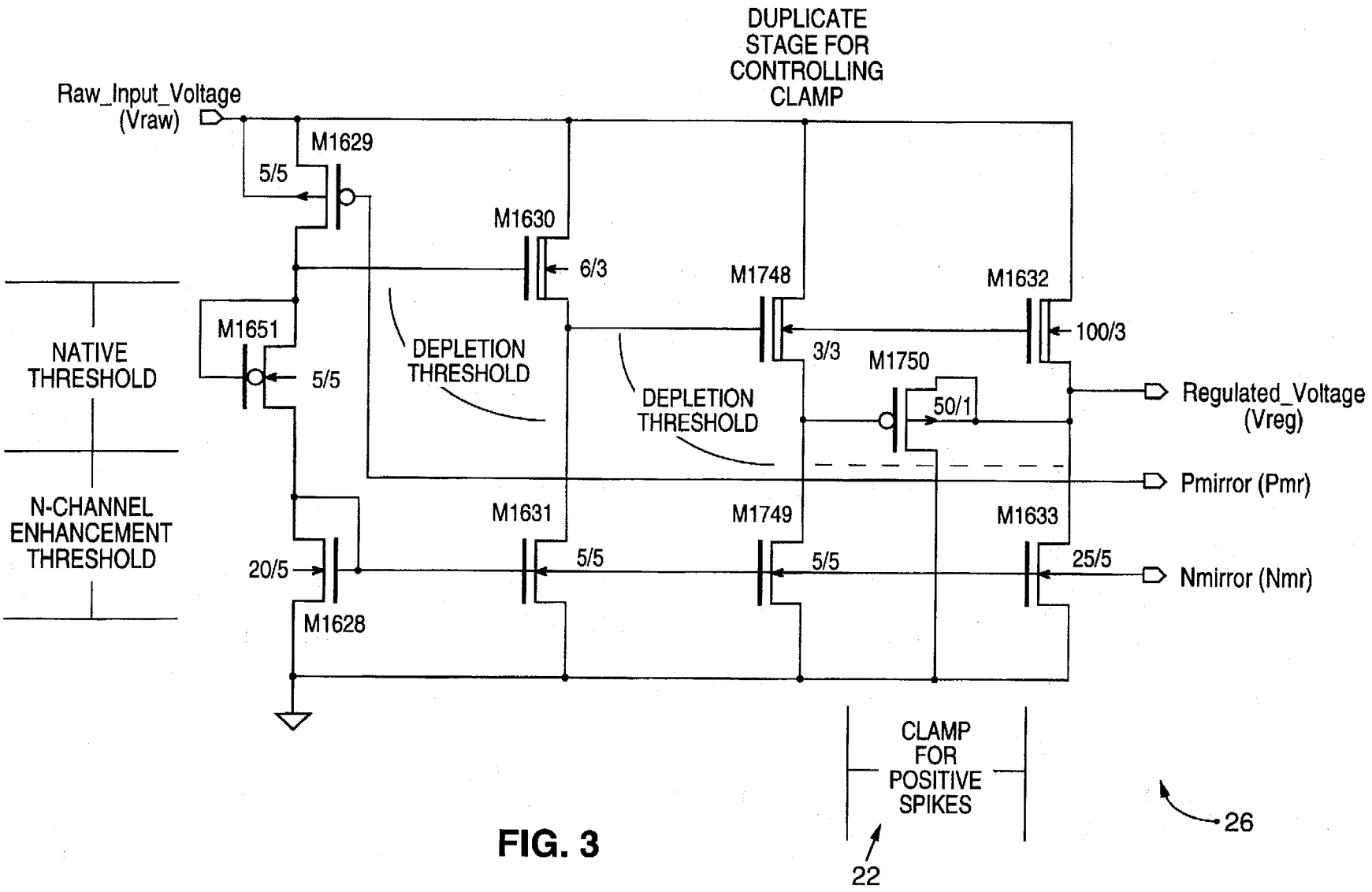
FIG. 3 is a schematic diagram of the voltage regulator portion of the circuit of FIG. 1.

Referring to FIG. 3, the voltage regulator portion 26 of the voltage reference and regulator section 20 includes transistors M1629, M1651 and M1628 from the voltage reference circuit 24, plus a series of cascaded depletion mode source follower circuits and the voltage clamp circuit 22. The current through transistor M1628 used to establish current mirror voltage NMR generates a pair of threshold voltage drops across transistors M1628 and M1651 to create an input voltage in the range of 1.0–1.5 volts for the cascaded source follower circuits. Two source follower circuits M1630/M1631 and M1632/M1633 then translate this input voltage further positively by two depletion mode transistor threshold voltages (approximately 1.2 volts each) and thereby produce a regulated output voltage VREG of approximately 3.5 volts. The second depletion mode transistor M1632 has a sufficiently large conductance to convey the required load current from the source of the unregulated supply voltage VRAW.

The currents dram from the source of the unregulated supply voltage VRAW to operate the voltage regulator are controlled by reference voltage NMR in such a manner as to be very small, e.g., several hundred nano-amperes each, in order to limit current drain from the source of the unregulated voltage VRAW. As a consequence thereof, any positive noise spikes which are coupled to the regulated voltage output node will not be adequately limited by the small pull-down current source M1633. Accordingly, transistor M1750 in the clamp circuit 22 is used to shunt such positive noise current spikes to circuit ground.

The gate voltage of transistor M1750 is driven by the output of a source follower stage M1748/M1749 which duplicates the output source follower stage M1632/M1633. Any positive noise spikes on the output voltage VREG which is greater in amplitude than the threshold voltage of P-MOSFET M1750 turns on transistor M1750, thereby shunting the output noise current to circuit ground. Transistor M1748 in the duplicate source follower stage M1748/M1749 is designed, i.e., sized, to be substantially weaker than the output depletion mode transistor M1632 so that the output voltage of this duplicate source follower stage M1748/M1749, i.e., at the gate of transistor M1750, is lower than that of the regulated output voltage VREG. Accordingly, a portion of the threshold voltage of transistor M1750 is already overcome in the absence of any noise at the output VREG, thereby more effectively limiting any positive noise spikes on the output voltage VREG.

Figure 4:
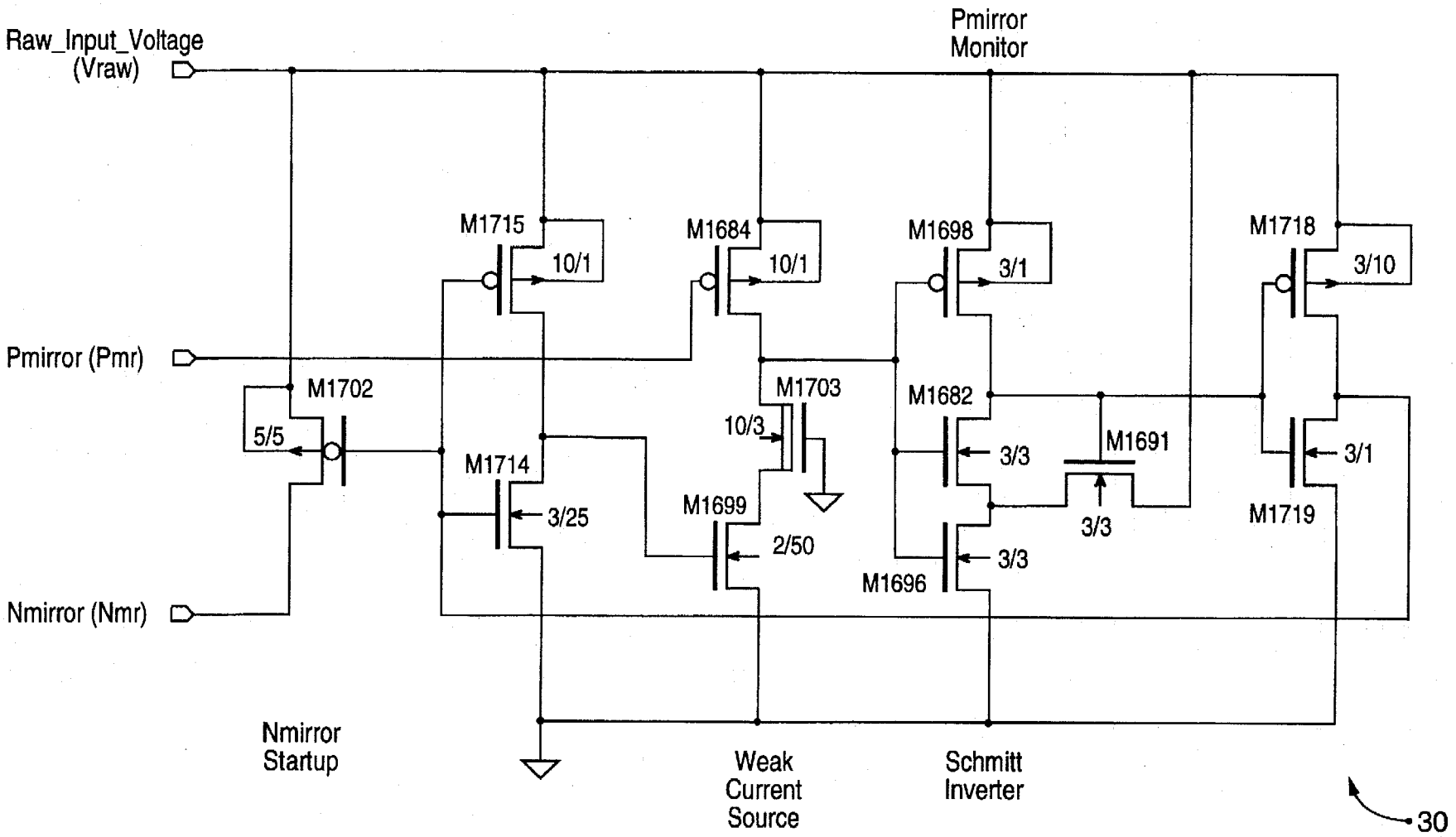
FIG. 4 is a schematic diagram of the automatic startup portion of the circuit of FIG. 1.

Referring to FIG. 4, the automatic startup section 30 senses reference voltage PMR. When reference voltage PMR is too low to turn on a P-MOSFET, a weak current source formed by transistors M1684, M1703 and M1699 pulls down the input node to a Schmitt inverter circuit M1698/M1682/M1696/M1691. The resulting positive output signal from the Schmitt inverter is then inverted by an inverter circuit M1718/M1719 to drive transistor M1702 which pulls up the node receiving reference voltage NMR, thus starting the voltage reference circuit 24 (FIG. 2). Once the voltage reference circuit 24 is started, reference voltage PMR goes high, thereby switching the Schmitt inverter circuit M1698/M1682/M1696/M1691. The output of the Schmitt inverter circuit then switches to a low state, which is inverted by inverter circuits M1718/M1719 and M1715/M1714, thereby turning off the weak current source M1684/M1703/M1699 by turning off transistor M1699. Hence, the automatic startup section 30 draws current from the source of the unregulated supply voltage VRAW only during an initial startup transient period.

Figure 5:
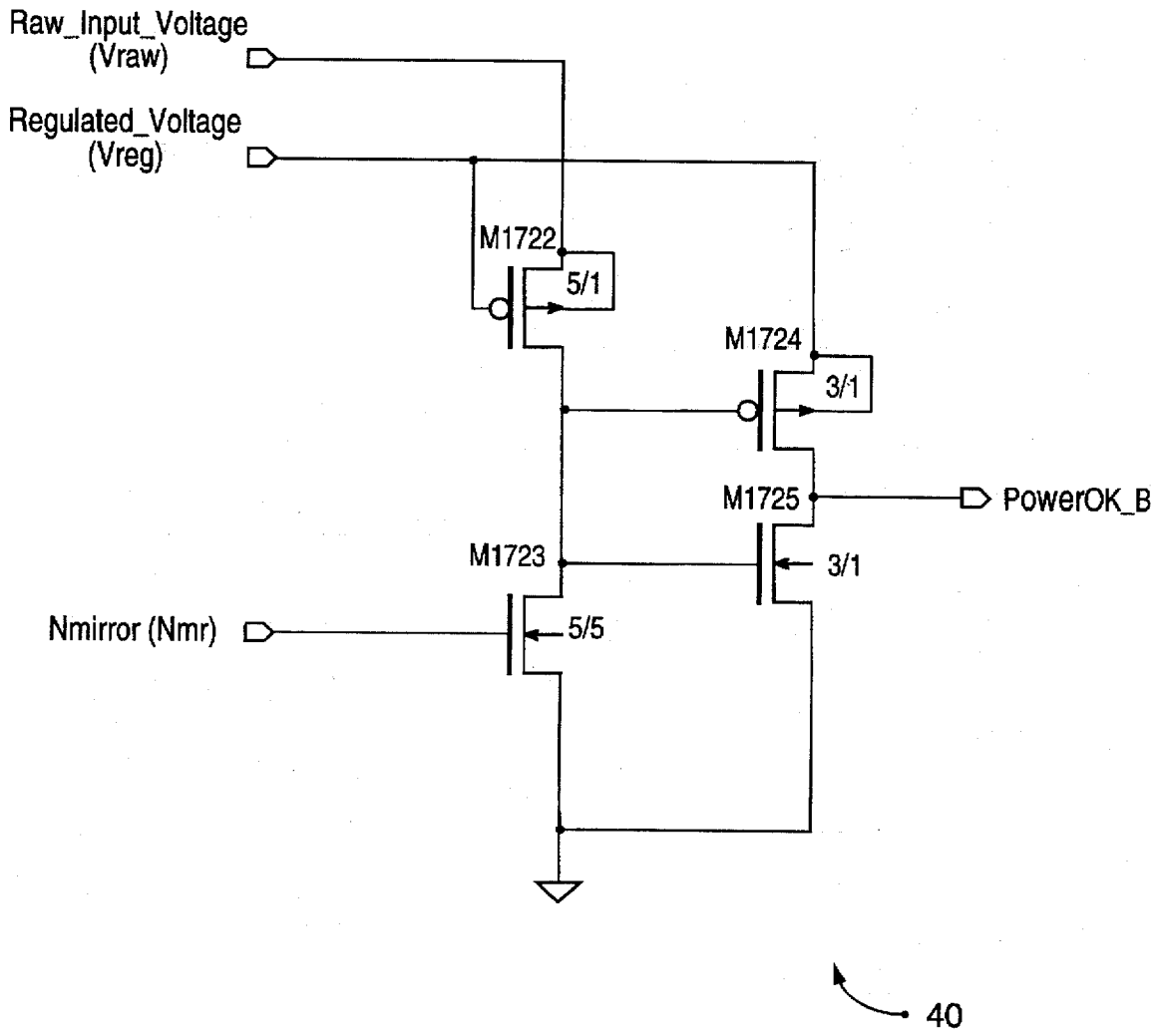
FIG. 5 is a schematic diagram of the power-ok indicator portion of the circuit of FIG. 1.

Referring to FIG. 5, the first stage M1722/M1723 of the power-ok indicator circuit 40 receives power from the source of the unregulated voltage VRAW. Transistor M1722 conducts current when the unregulated voltage VRAW exceeds the regulated voltage VREG by a P-MOSFET threshold voltage. Accordingly, notwithstanding any conduction by transistor M1723 due to the application of reference voltage NMR, the drain terminal of transistor M1722 is pulled high, thereby turning output inverting buffer stage transistors M1724 and M1725 off and on, respectively, thereby asserting the power-ok signal (active low). Conversely, when the unregulated input voltage VRAW is less than one P-MOSFET threshold voltage greater than the regulated voltage VREG, transistor M1722 is turned off and transistor M1723, turned on by the relatively weak reference voltage NMR, turns output inverting buffer stage transistors M1724 and M1725 on and off, respectively, thereby de-asserting the power-ok signal (inactive high).

Figure 6:
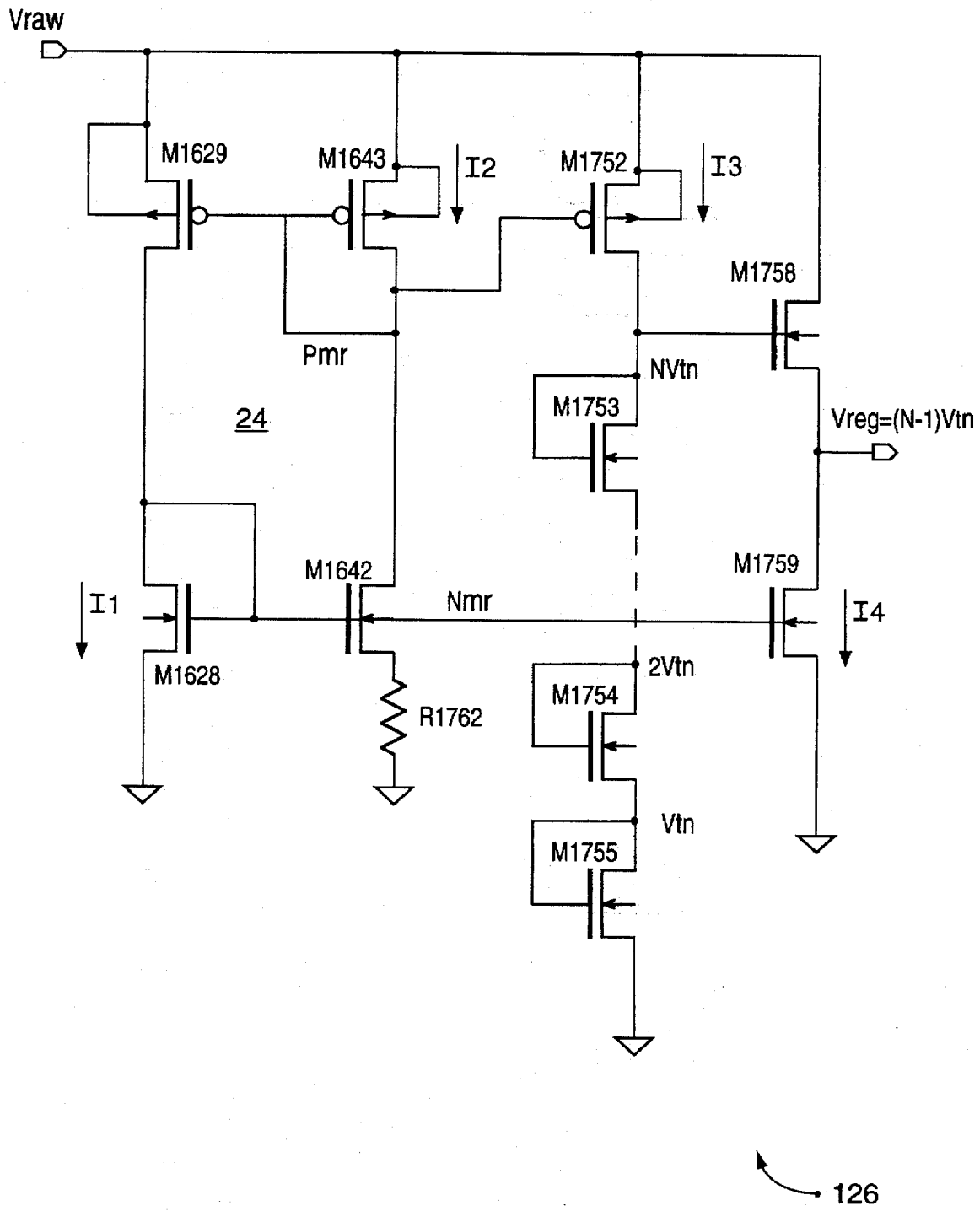
FIG. 6 is a schematic diagram of a voltage regulator circuit in accordance with another embodiment of the present invention.

Referring to FIG. 6, a voltage regulator circuit 126 in accordance with another embodiment of the present invention provides the regulated output voltage VREG using reference voltages PMR and NMR which are generated by the voltage reference circuit 24 (FIG. 2). A series of N ($N \epsilon \{1,2,3, \ldots\}$) diode connected enhancement mode N-MOSFETs M1753, M1754, M1755 are used to build up, i.e., from circuit ground, the voltage at the gate of the output source follower transistor M1758. This voltage is equal to N threshold voltages (where N, as indicated by the dashed line, can be any number). Accordingly, the regulated output voltage VREG at the source of transistor M1758 is one threshold voltage value below that. The current for these diode connected transistors is provided by transistor M1752 which is connected to form a current mirror such that current I3 is proportional to current mirror reference current I2.

Figure 7:
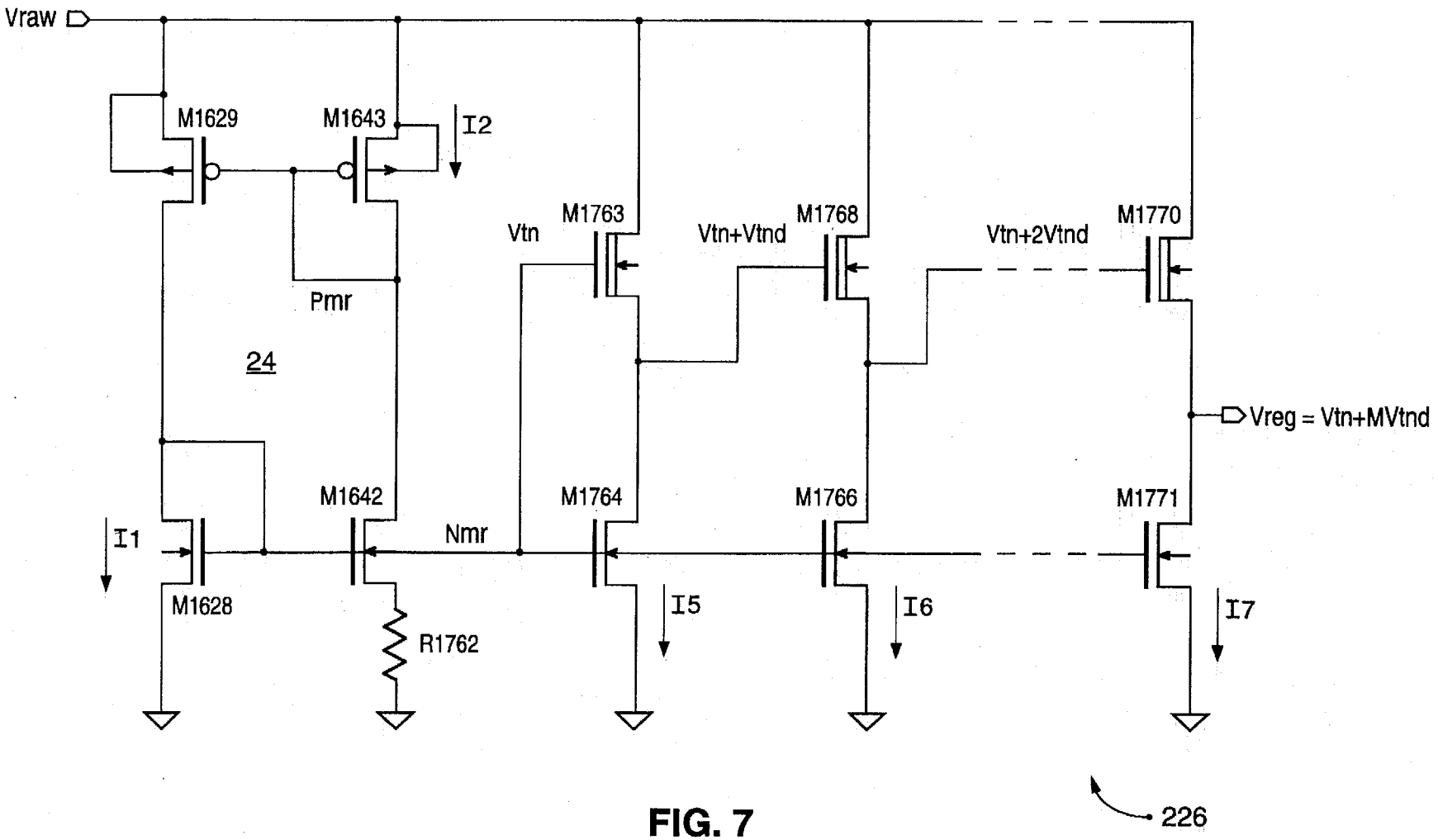
FIG. 7 is a schematic diagram of a voltage regulator circuit in accordance with still another embodiment of the present invention.

Referring to FIG. 7, a voltage regulator circuit 226 in accordance with still another embodiment of the present invention uses reference voltage NMR from the voltage reference circuit 24 (FIG. 2) to drive a series of M ($M \epsilon \{1, 2,3, \ldots\}$) N-MOSFETs M1764, M1766, M1771 to conduct mirror currents I5, I6 and I7 which are proportional to current mirror reference current I1. These mirror currents I5, I6, I7 are used to drive a series of M corresponding depletion mode transistors M1763, M1768, M1770 which, in turn are used to build up, from reference voltage NMR, the regulated output voltage VREG by one depletion mode threshold voltage VTND for each depletion mode device. Accordingly, as indicated by the dashed lines, for M depletion mode source follower stages, the output regulated voltage has a value which is M depletion mode threshold voltages greater than reference voltage NMR.

Figure 8:
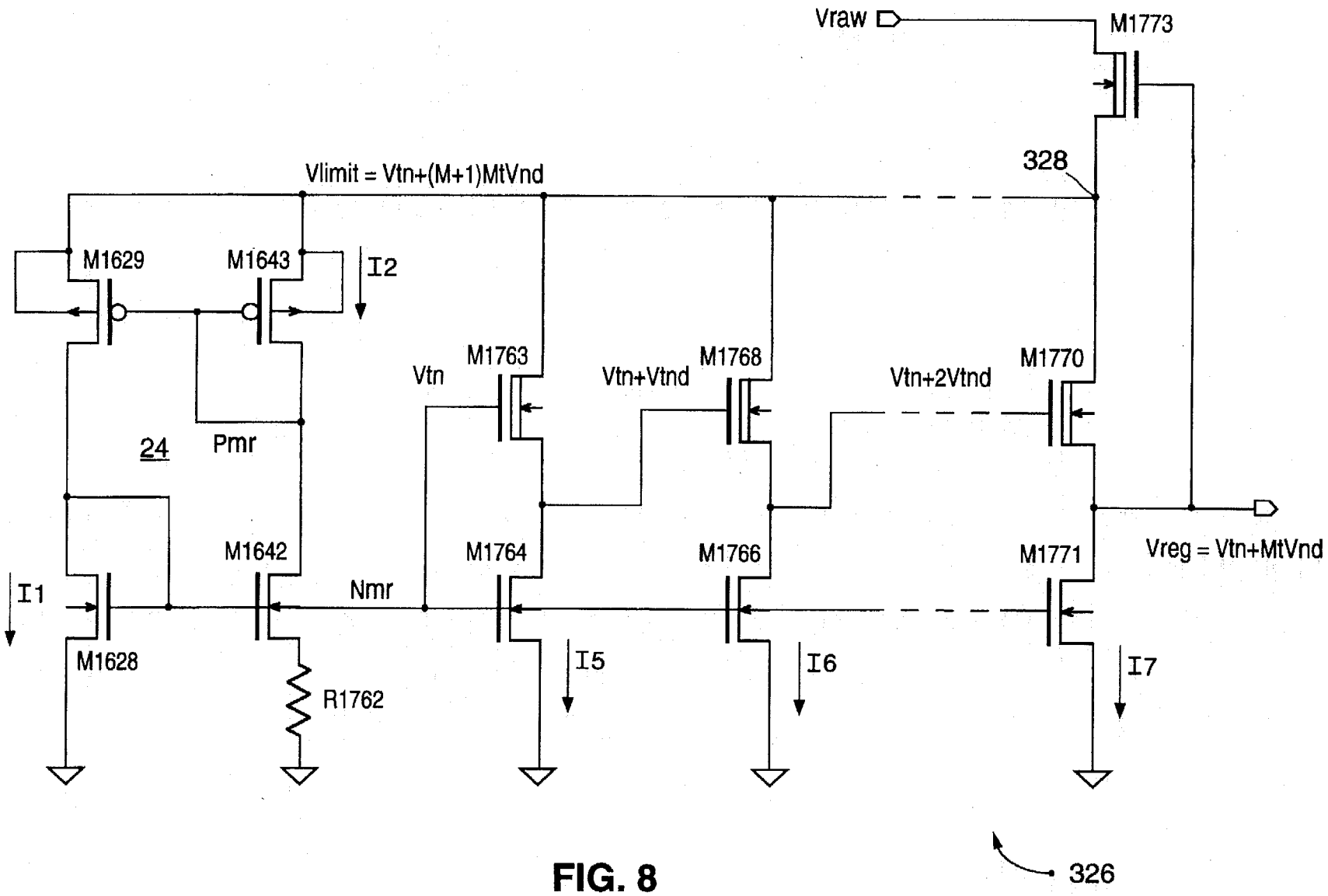
FIG. 8 is a schematic diagram of a voltage regulator circuit in accordance with yet another embodiment of the present invention.

Referring to FIG. 8, a voltage regulator circuit 326 in accordance with yet another embodiment of the present invention includes an improvement over the voltage regulator circuit 226 of FIG. 7, i.e., buffer transistor M1773 connected between the source of the unregulated input voltage VRAW and the node 328 which serves as the local power supply node. Buffer transistor M1773 is designed to have a higher breakdown voltage than the P-MOSFET and N-MOSFET devices used in this circuit 326. The regulated output voltage VREG is used to bias the gate of transistor M1773, thereby limiting its source voltage at node 328 (VLIMIT) to approximately one depletion threshold voltage above the regulated output voltage VREG.

Figure 9A:
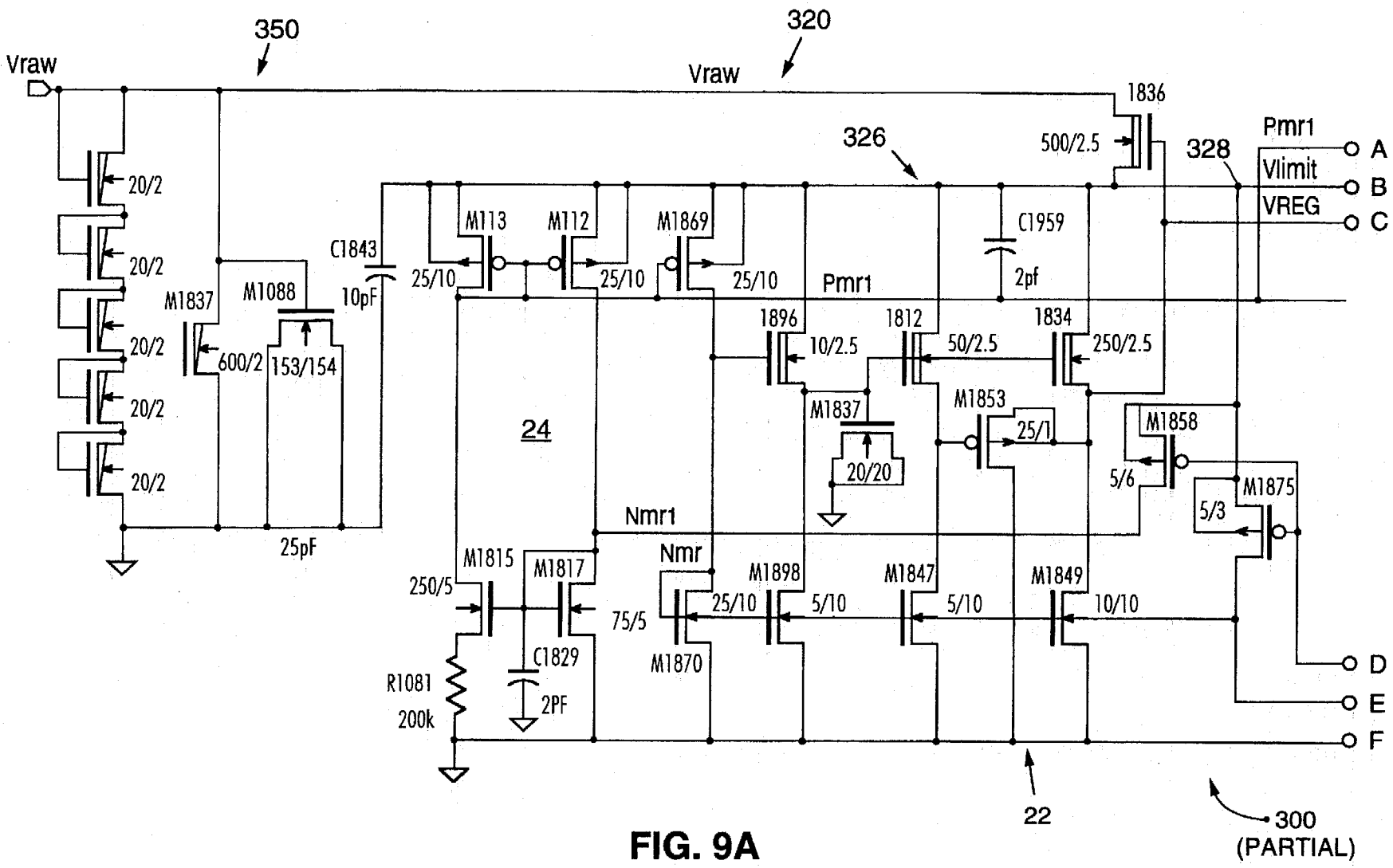
FIGS. 9A, 9B and 9C together form a schematic diagram of a voltage reference and regulator, power-ok indicator and automatic startup circuit using the voltage regulator of FIG. 8.
Figure 9B:
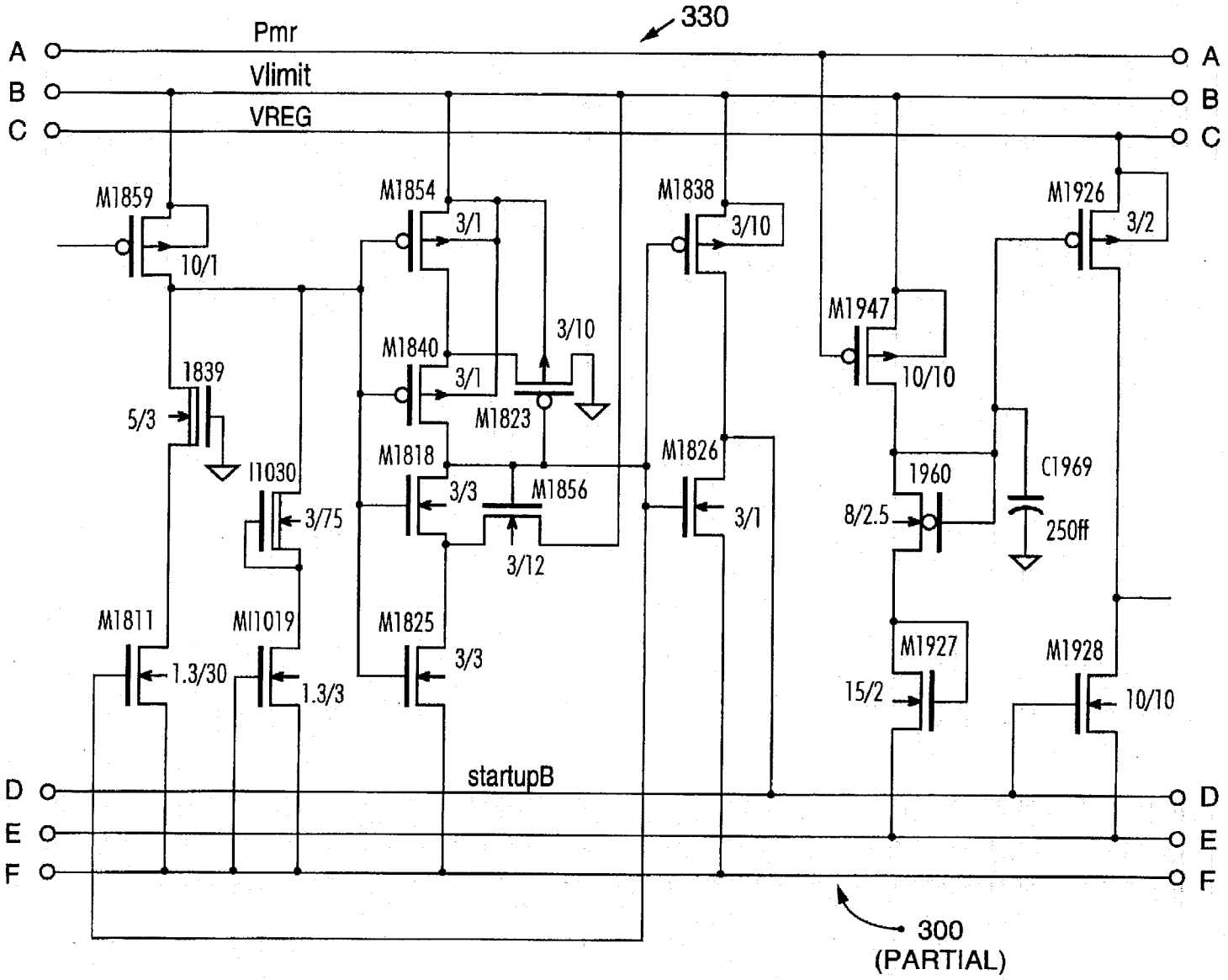
Figure 9C:
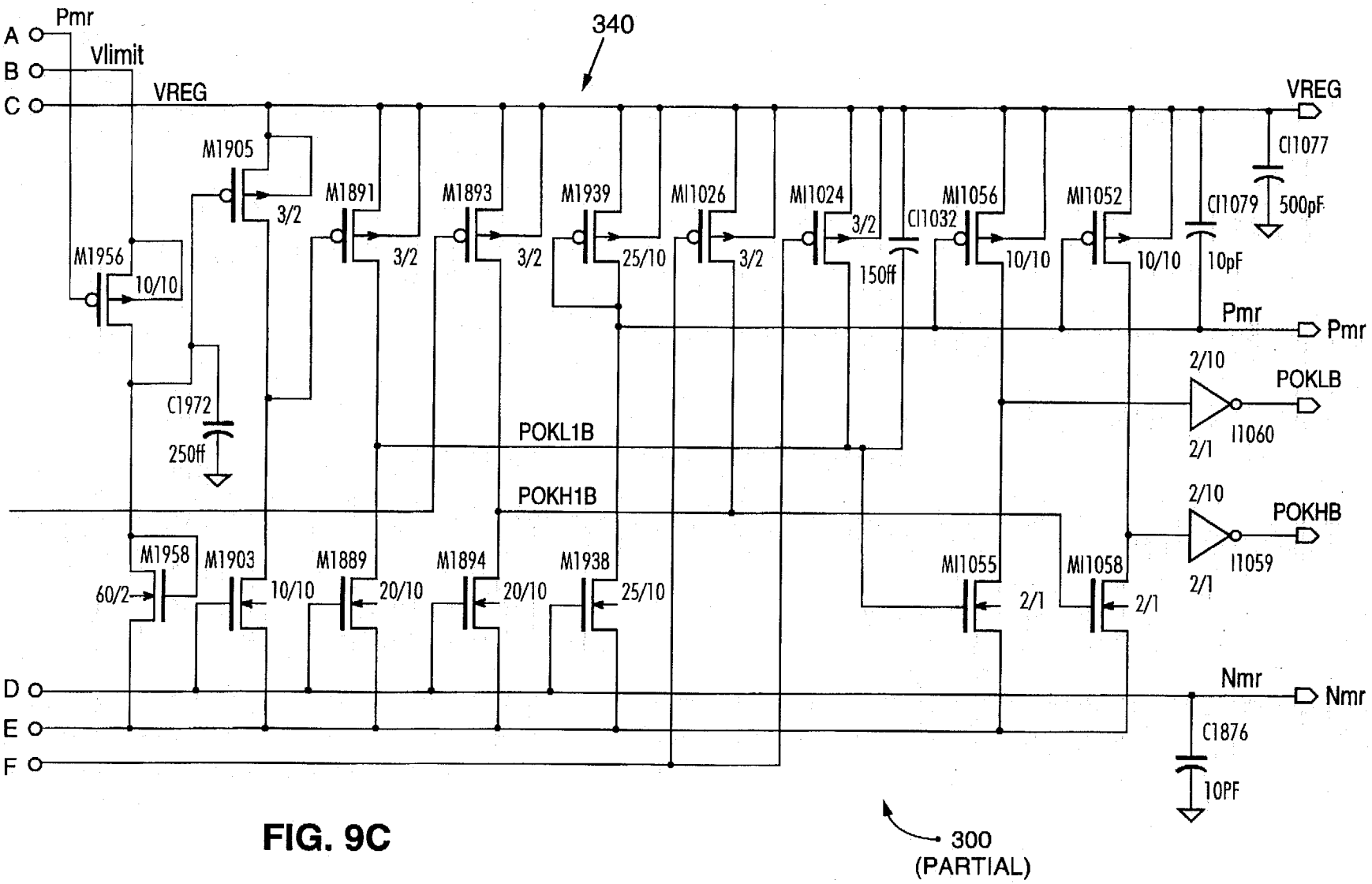

Referring to FIGS. 9A and 9B, the voltage regulator circuit 326 of FIG. 8 (with M=2) can be used in a voltage reference and regulator, power-ok indicator and automatic startup circuit 300 which is similar to the circuit 10 of FIG. 1. This circuit 300 also includes a voltage reference and regulator section 320, an automatic startup section 330 and a power-ok indicator section 340. The voltage reference and regulator section 320 includes a voltage reference circuit 24 (FIG. 2) and a voltage regulator circuit 326 (FIG. 8) which includes a voltage clamp circuit 22 (FIG. 3).

This circuit 300 also includes a voltage limiting section 350 which limits the magnitude of the unregulated input voltage VRAW. When the unregulated input voltage VRAW exceeds the cumulative threshold voltages of the stacked diode connected N-MOSFETs, the current through such transistors is mirrored and scaled up by N-MOSFET M1857, thereby shunting excess current from the source of the unregulated input voltage VRAW to circuit ground and thus limiting the maximum value of voltage VRAW.

The automatic startup section 330 in this circuit 300 operates in a manner similar to that described above in connection with the automatic startup circuit 30 of FIG. 4. The power-ok indicator section 340 provides power indicator signals POKLB and POKHB both of which are active low and indicate whether the regulated output voltage VREG exceeds predetermined lower and upper voltage levels, respectively. Such lower and upper voltage levels are predetermined in accordance with the threshold voltages for transistors M1905 and M1926, respectively. Additionally, following a rise in the regulated output voltage VREG above such predetermined voltage levels, in the event that the limited input voltage VLIMIT falls below either one or both of such voltage levels, the corresponding power indicator signal POKLB, POKHB will switch to a logic high, thereby warning of a drop in the unregulated input voltage VRAW.

Various other modifications and alterations in the structure and method of operation of this invention will be apparent to those skilled in the art without departing from the scope and spirit of the invention. Although the invention has been described in connection with specific preferred embodiments, it should be understood that the invention as claimed should not be unduly limited to such specific embodiments. It is intended that the following claims define the scope of the present invention and that structures and methods within the scope of these claims and their equivalents be covered thereby.

What is claimed is:

1. An apparatus including a voltage regulator for coupling to an unregulated power source and regulating a voltage and conveying a current received therefrom, said voltage regulator comprising:

a reference node configured to operate at a reference voltage having a fixed reference voltage potential;

a first input node configured to be coupled to an unregulated power source, convey a source current therefrom and receive and convey a first input voltage having a first input voltage potential relative to said fixed reference voltage potential, wherein a difference between said first input voltage and said reference voltage has a first input voltage magnitude which is greater than a first predetermined minimum;

a bias voltage generator, coupled between said first input node and said reference node, configured to receive said first input voltage and said reference voltage and in accordance therewith provide a bias voltage having a bias voltage potential between said first input voltage potential and said fixed reference voltage potential; and a voltage translator, coupled between said first input node and said reference node and to said bias voltage generator, configured to receive said first input voltage, said reference voltage and said bias voltage and in accordance therewith convey said source current and provide a regulated voltage having a regulated voltage potential between said first input voltage potential and said fixed reference voltage potential, wherein said regulated voltage is translated from said reference voltage and said regulated voltage potential is substantially fixed relative to said fixed reference voltage potential and remains substantially fixed relative thereto regardless of variations in said first input voltage magnitude.

2. The apparatus of claim 1, wherein said bias voltage is translated from said reference voltage and said bias voltage potential is substantially fixed relative to said fixed reference voltage potential and remains substantially fixed relative thereto regardless of variations in said first input voltage magnitude.

3. The apparatus of claim 1, wherein said bias voltage generator comprises a diode connected transistor connected to said reference node.

4. The apparatus of claim 1, wherein said bias voltage generator comprises a current mirror circuit.

5. The apparatus of claim 1, wherein said voltage translator comprises a plurality of serially coupled diode connected transistors connected to said reference node.

6. The apparatus of claim 1, wherein said voltage translator comprises a plurality of cascaded depletion mode source follower amplifier circuits.

7. The apparatus of claim 1, wherein said voltage regulator further comprises:

a second input node configured to be coupled between said unregulated power source and said first input node, convey therefrom said source current and receive and convey therefrom a second input voltage having a second input voltage potential relative to said fixed reference voltage potential, wherein said first input voltage potential is between said second input voltage potential and said fixed reference voltage potential, and wherein a difference between said second input voltage and said reference voltage has a second input voltage magnitude which is greater than a second predetermined minimum; and a buffer circuit, coupled between said second input node and said first input node, configured to receive said second input voltage and said regulated voltage and in accordance therewith provide said first input voltage and convey said source current, wherein said regulated voltage potential remains substantially fixed relative to said fixed reference voltage potential regardless of variations in said second input voltage magnitude.

8. An apparatus including a voltage regulator for coupling to an unregulated power source and regulating a voltage and conveying a current received therefrom, said voltage regulator comprising:

a reference node configured to operate at a reference voltage having a fixed reference voltage potential;

an input node configured to be coupled to an unregulated power source, convey therefrom a source current and receive and convey therefrom an input voltage having an input voltage potential relative to said fixed reference voltage potential, wherein a difference between said input voltage and said reference voltage has an input voltage magnitude which is greater than a first predetermined minimum;

a buffer circuit, coupled to said input node, configured to receive said input voltage and a regulated voltage and in accordance therewith convey said source current and provide a limited voltage having a limited voltage potential relative to said fixed reference voltage potential, wherein said limited voltage potential is between said input voltage potential and said fixed reference voltage potential, and wherein a difference between said limited voltage and said reference voltage has a limited voltage magnitude which is greater than a second predetermined minimum;

a current mirror circuit, coupled between said buffer circuit and said reference node, configured to receive said limited voltage and said reference voltage and in accordance therewith provide a bias voltage having a bias voltage potential between said limited voltage potential and said fixed reference voltage potential; and a plurality of cascaded depletion mode source follower amplifier circuits, coupled between said buffer circuit and said reference node and to said current mirror circuit, configured to receive said limited voltage, said reference voltage and said bias voltage and in accordance therewith convey said source current and provide said regulated voltage having a regulated voltage potential between said input voltage potential and said fixed reference voltage potential, wherein said regulated voltage is translated from said reference voltage and said regulated voltage potential is substantially fixed relative to said fixed reference voltage potential and remains substantially fixed relative thereto regardless of variations in said input voltage magnitude.

9. The apparatus of claim 8, wherein said bias voltage is translated from said reference voltage and said bias voltage potential is substantially fixed relative to said fixed reference voltage potential and remains substantially fixed relative thereto regardless of variations in said input voltage magnitude.

10. A method of regulating a voltage and conveying a current received from unregulated power source, said method comprising the steps of:

operating a reference node at a reference voltage having a fixed reference voltage potential;

conveying a source current from an unregulated power source;

receiving and conveying a first input voltage having a first input voltage potential relative to said fixed reference voltage potential, wherein a difference between said first input voltage and said reference voltage has a first input voltage magnitude which is greater than a first predetermined minimum;

receiving said first input voltage and said reference voltage and in accordance therewith generating a bias voltage having a bias voltage potential between said first input voltage potential and said fixed reference voltage potential; and receiving said first input voltage and said bias voltage and in accordance therewith conveying said source current and generating a regulated voltage having a regulated voltage potential between said first input voltage potential and said fixed reference voltage potential, wherein said regulated voltage is translated from said reference voltage and said regulated voltage potential is substantially fixed relative to said fixed reference voltage potential and remains substantially fixed relative thereto regardless of variations in said first input voltage magnitude.

11. The method of claim 10, wherein said step of receiving said first input voltage and in accordance therewith generating a bias voltage having a bias voltage potential between said first input voltage potential and said fixed reference voltage potential comprises translating said bias voltage from said reference voltage, wherein said bias voltage potential is substantially fixed relative to said fixed reference voltage potential and remains substantially fixed relative thereto regardless of variations in said first input voltage magnitude.

12. The method of claim 10, wherein said step of receiving said first input voltage and in accordance therewith generating a bias voltage having a bias voltage potential between said first input voltage potential and said fixed reference voltage potential comprises generating said bias voltage with a diode connected transistor connected to said reference node.

13. The method of claim 10, wherein said step of receiving said first input voltage and in accordance therewith generating a bias voltage having a bias voltage potential between said first input voltage potential and said fixed reference voltage potential comprises generating said bias voltage with a current mirror circuit.

14. The method of claim 10, wherein said step of receiving said first input voltage and said bias voltage and in accordance therewith conveying said source current and generating a regulated voltage having a regulated voltage potential between said first input voltage potential and said fixed reference voltage potential comprises generating said regulated voltage with a plurality of serially coupled diode connected transistors connected to said reference node.

15. The method of claim 10, wherein said step of receiving said first input voltage and said bias voltage and in accordance therewith conveying said source current and generating a regulated voltage having a regulated voltage potential between said first input voltage potential and said fixed reference voltage potential comprises generating said regulated voltage with a plurality of cascaded depletion mode source follower amplifier circuits.

16. The method of claim 10, further comprising the steps of:

conveying from said unregulated power source a second input voltage having a second input voltage potential relative to said fixed reference voltage potential, wherein said first input voltage potential is between said second input voltage potential and said fixed reference voltage potential, and wherein a difference between said second input voltage and said reference voltage has a second input voltage magnitude which is greater than a second predetermined minimum; and receiving said second input voltage and said regulated voltage and in accordance therewith generating said first input voltage and conveying said source current, wherein said regulated voltage potential remains substantially fixed relative to said fixed reference voltage potential regardless of variations in said second input voltage magnitude.

* * * * *